US005687646A

United States Patent [19]

Sakaguchi

[11] Patent Number: 5,687,646

[45] Date of Patent: Nov. 18, 1997

[54] METHOD OF PRODUCING STENCILS FOR USE IN SILK-SCREEN PRINTING

[76] Inventor: Akenobu Sakaguchi, 24-14, Aoyamadai 4-chome, Abiko-shi, Chiba 270-11, Japan

[21] Appl. No.: 507,383

[22] PCT Filed: Mar. 16, 1994

[86] PCT No.: PCT/JP94/00422

§ 371 Date: Aug. 31, 1995

§ 102(e) Date: Aug. 31, 1995

[87] PCT Pub. No.: WO94/21463

PCT Pub. Date: Sep. 29, 1994

[30] Foreign Application Priority Data

Mar. 17, 1993 [JP] Japan ..... 5-082574

[51] Int. Cl.[6] ..... B41M 1/12

[52] U.S. Cl. ..... 101/129; 101/128.4

[58] Field of Search ..... 101/129, 114, 101/127.1, 128.1, 128, 126, 128.4

[56] References Cited

U.S. PATENT DOCUMENTS

| | | | |
|---|---|---|---|
| 1,299,969 | 4/1919 | Lewis | 101/128.4 |
| 3,049,993 | 8/1962 | Kobrin | 101/127.1 |
| 5,243,906 | 9/1993 | Okusawa | 101/128.4 |
| 5,491,503 | 2/1996 | Fuwa | 101/128.4 |

FOREIGN PATENT DOCUMENTS

| | | | |
|---|---|---|---|
| 2273663 | 2/1976 | France | 101/123 |
| 2446182 | 9/1980 | France | 101/123 |
| 2824887 | 10/1979 | Germany | 101/123 |
| 14918 | of 1914 | United Kingdom | 101/128.4 |
| 320153 | 10/1929 | United Kingdom | 101/127.1 |

*Primary Examiner*—Edgar S. Burr
*Assistant Examiner*—Anthony H. Nguyen
*Attorney, Agent, or Firm*—Jones, Tullar & Cooper, P.C.

[57] ABSTRACT

The present invention relates to a method of producing stencils, which permits the substantial reduction of time involved for producing stencils, facilitating the producing of stencils and improving the precision with which stencils can be produced. The method comprises the steps of fixing silk stretched over a frame, the silk having a heat sensitive film attached thereof; putting the frame on a flat table at a predetermined position, allowing the silk to cover the whole area of a platen, which is laid on the flat table; and sweeping the screen with a movable heating head to make pores in the heat-sensitive film of the screen, thereby producing a framed stencil.

3 Claims, 4 Drawing Sheets

METHOD OF PRODUCING STENCILS FOR USE IN SILK-SCREEN PRINTING

TECHNICAL FIELD

The present invention relates to a method of producing stencils for use in silk-screen printing.

BACKGROUND ART

A photomechanical process has been used in producing stencils for use in silk-screen printing. According to this process a positive bearing images or letters is applied to an emulsion-coated screen, and the resulting laminated object is exposed to intense light, thereby impressing the images or letters on the screen. An emulsion coating on those areas which have been exposed to the light is hardened by the action of light, and an emulsion coating on the remaining areas which have not been exposed to the light is not hardened. The images or letters which have been transferred from the positive to the screen are developed by washing and removing the emulsion coating which is not hardedned, thereby exposing the fine mesh of the selected areas of the screen in the form of an image or letter pattern. Thus, a stencil having images or letters transfered from the positive is provided for use in silk-screen printing after the screen has been dried.

There are some problem, however, in producing stencils by the photomechanical process. Appropriate positives are difficult to produce; light is liable to leak in the course of exposure; emulsion and other chemical agents smell bad; and an increased number of production steps are required, and accordingly the installation is enlarged, and the working time involved is extended.

Recently the method of producing stencils by a heat-sensitive printer has been widely used because of convenience and advantages of: not requiring such a large installation as in the photomechanical process; requiring no skillfulness; and producing no bad smell.

No matter which process may be used, however, the stencil must be fixed to a frame, and disadvantageously the stencil is likely to deviate from a correct position relative to the frame when the screen is stretched over the frame in fixing to the frame. Even a minute deviation of the screen from the correct position will cause a significant printing drift, and noticeable color drift in case of multi-color printing, thus deteriorating the quality of printing.

In view of these one object of the present invention is to provide apparatus which is guaranteed to be free of these problems, permitting the substantial reduction of working time involved a method of producing stencils for use in silk-screen printing, which method assures that image or letter patterns are put on the screen stretched over the frame at correct positions relative to the frame, not requiring any fine adjustment in positioning and fixing the stencil to the frame as has been hitherto required in conventional methods.

SUMMARY OF THE INVENTION

The method of producing stencils for use in silk-screen printing according to the present invention comprises the steps of:

fixing silk stretched over a frame, the silk having a heat sensitive film attached thereto;

putting the frame on a flat table at a predetermined position, allowing the silk to cover the whole area of a platen, which is laid on the flat table; and sweeping the screen with a movable heating head to make pores in the heat-sensitive film of the screen, thereby producing a frames stencil.

Pores are made to form image or letter patterns in the screen, which is stretched over the frame and is fixed thereto, and therefore, the so formed image or letter patterns are guaranteed to be put in correct positions.

DESCRIPTION OF THE BEST MODE OF CARRYING OUT THE PRESENT INVENTION

Figure 1:
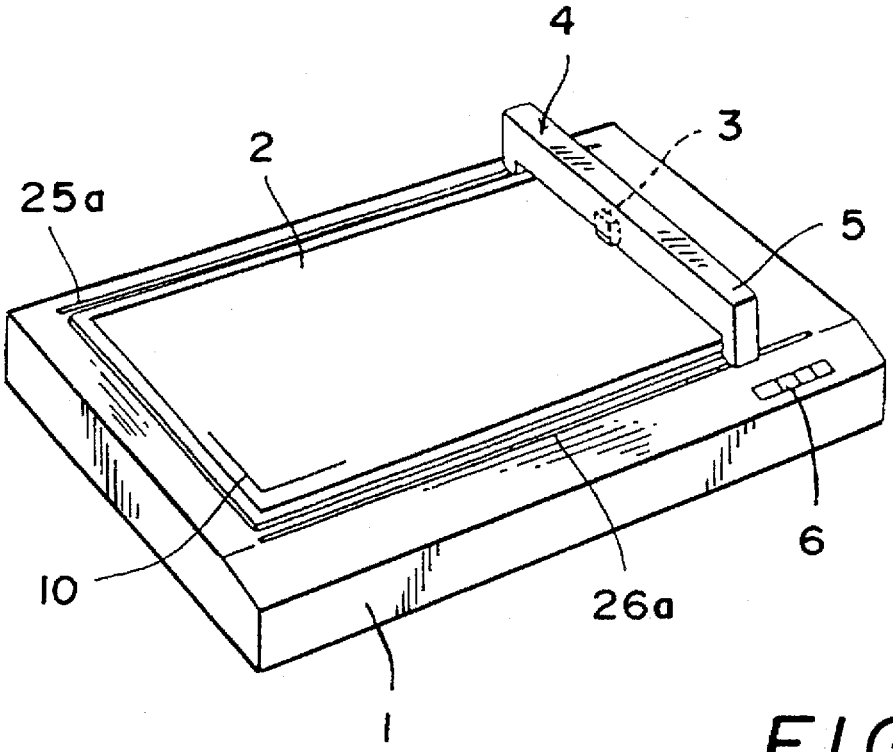
FIG. 1 is a perspective view of a stencil producing device which is used in producing stencils according to the present invention.

Referring to the drawings, particularly to FIG. 1, a stencil producing device which is used in producing stencils according to the present invention comprises a casing 1, a flat top or table 2 laid on the casing 1 for producing stencils, and a drive mechanism 4 for moving a heating head 3. The drive mechanism 4 is placed on the flat top 2, and it has a cover 5 to enclose the part of the drive mechanism appearing above from the casing 1. Operating switches are placed in the operating section 6 of the casing 1.

A screen 7 having a heat-sensitive film attached thereto is fixed to a frame, and the screen-and-frame 8 and a rubber flat platen 9 are put on the flat top 2 with the platen 9 laid inside the frame 8, and with the screen 7 laid closely on the platen 9. The flat top 2 has a reference means with respect to which the screen-and-frame is positioned on the flat top 2. Such reference means may comprise 90-degree angle lines 10 or ridges (not shown) to permit registration of selected corners of the frame 8 relative to the reference.

Figure 2:
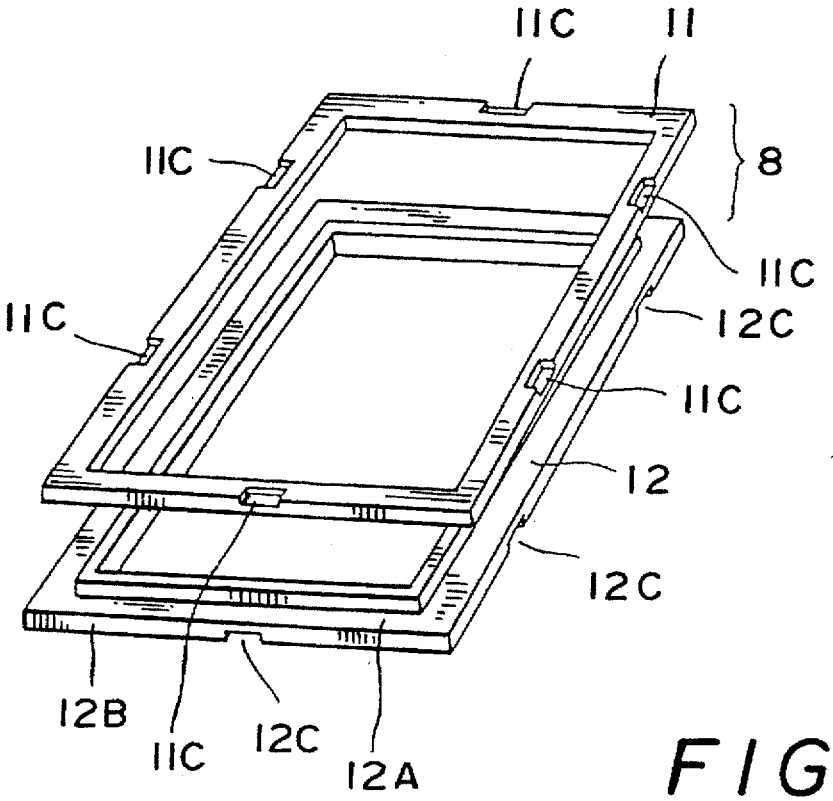
FIG. 2 is a perspective view of a frame for fixing a screen.

As seen from FIG. 2, the frame 8 for fixing a screen 7 comprises an upper frame half 11 and a lower frame half 12. The lower frame half 12 comprises an outside flat edge 12A and an inside riser 12B to fit in the upper frame half 11. Each frame half has recesses 11C, 12C made in its four sides to catch clips 41 for holding the upper and lower frame halves 11 and 12 together.

Figure 3:
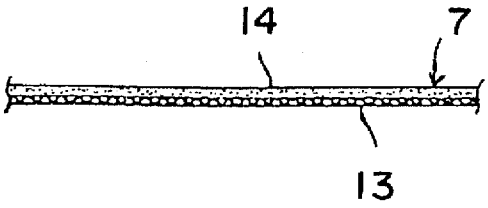
FIG. 3 is an enlarged longitudinal section of a screen having a heat-sensitive film.

As seen from FIG. 3, the screen 7 comprises a fine-meshed gauze 13 lined with a heat-sensitive film 14. The heat-sensitive film 14 may be for example, polyester film, the thickness of which ranges from 1.5 to 1.8 microns. A fine-meshed gauze of silk, nylon or polyester thread or wire gauze may be used. As for an adhesive agent for use in gluing the gauze 13 and the heat-sensitive film 14 it must be an oil adhesive agent if aqueous ink is used in printing, and must be an aqueous agent if oil ink is used in printing to prevent the laminated layers from separating from each other, and the stencil can be used long.

Figure 5:
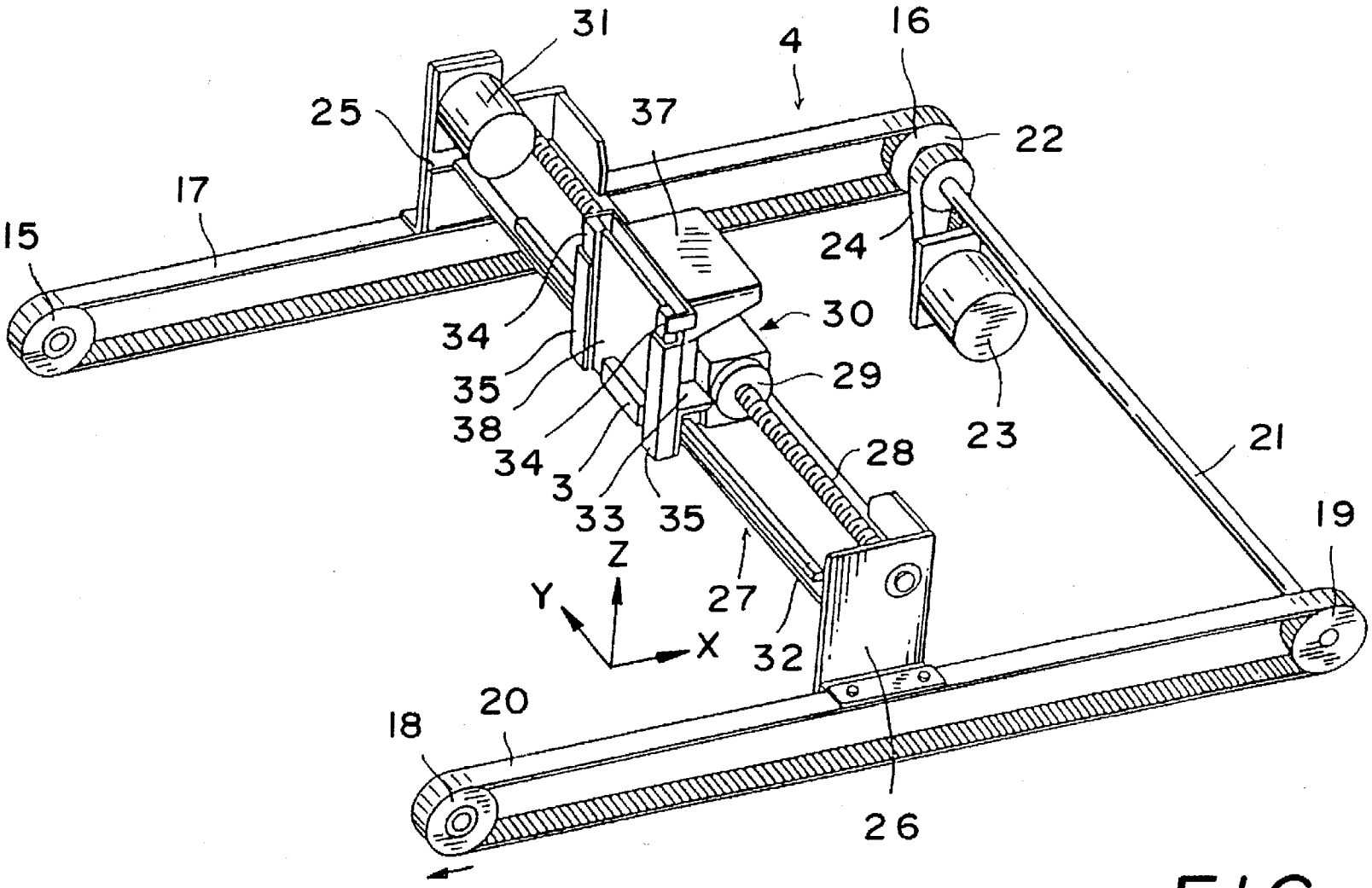
FIG. 5 is a perspective view of a mechanism for moving a heating head in all directions.

FIG. 5 is a perspective view of a drive mechanism for moving a heating head with its cover 5 removed. As seen from the drawing, an endless belt 17 wound around its opposite pulleys 15 and 16 and another endless belt 20 wound around its opposite pulleys 18 and 19 are arranged within the casing 1, running parallel along the opposite longitudinal sides of the flat top 2. The pulleys 16 and 19 are fixed to a drive axle 21, which can be rotated in one and the other direction.

The drive axle 21 has a belt-driving pulley 22 fixed thereto, and the belt-driving pulley 22 is connected to the shaft of an X-axis drive motor 23 via an associated endless belt 24. The opposite endless belts 17 and 20 have upright mounting plates 25 and 26 fixed thereto, and these mounting plates 25 and 26 are slidably inserted in longitudinal slots 25*a* and 26*a*, which are made in the opposite longitudinal edges of the casing 1. A traverse assembly 27 is fixed to the opposite mounting plates 25 and 26, so that the traverse assembly 27 can be driven in the X-axis direction.

A threaded rod 28 is rotatably fixed to the opposite mount plates 25 and 26, and it has a nut 29 threadedly engaged therewith. A movable body 30 is integrally connected to the nut 29 so that it can be driven on the threaded rod 28 in the Y-axis direction. One end of the threaded rod 28 is connected to a Y-axis drive motor 31 via associated gears (not shown). A guide rail 32 is fixed to the opposite mounting plates 25 and 26 for guiding the Y-axis movable body 30 along the threaded rod 28.

The Y-axis movable body 30 has joint pieces 33 on its opposite sides, and a pair of slotted guide poles 35, 35 are integrally connected to the joint pieces 33, 33. Rising-and-descending rods 34 are slidably fitted in the slots of the opposite slotted guide poles 35, 35. Also, plunger-and-solenoids 36 are fixed to the joint pieces 33, and the plungers (not shown) are connected to a Z-axis movable body 37. A heat sink plate 38 is fixed to the opposite rising-and-descending rods 34, which are, in turn, are connected to the Z-axis movable body 37. A heating head 3 is directed downward, and is fixed to the lower edge of the heat sink plate 38.

Data pertaining to images and letters to be transferred are prepared with the aid of appropriate computers, and the so prepared data are stored in memories. In producing stencils data are transfered to a latch associated with the heating head 3, and pieces of data are read out in time-controlled sequence to supply electric current to selected heating elements.

As described above, a stencil is produced in the condition in which a screen 7 having a heat-sensitive film attached thereto is stretched over and fixed to the frame 8. FIG. 4 shows one example of stretching a screen 7 over a frame and fixing it to the frame.

Figure 4A:
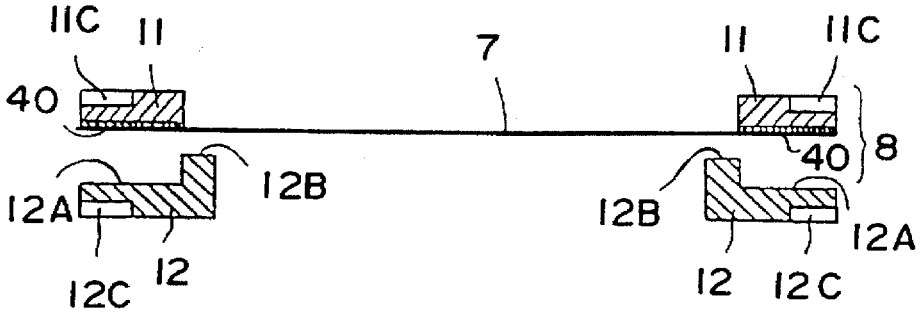
FIGS. 4(A), 4(B) and 4(C) are longitudinal sections showing how the screen is fixed to the frame.
Figure 4B:
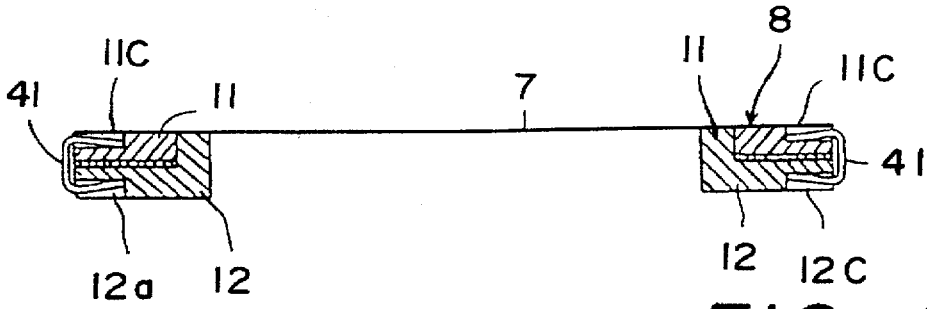
Figure 4C:
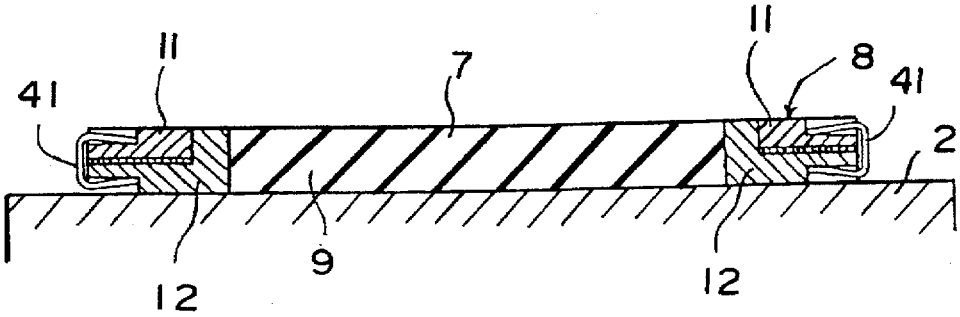

First, a double-adhesive tape 40 is applied to the whole lower surface of the upper frame half 11, and the screen 7 is applied and tentatively fixed to the lower surface of the upper frame half 11 with its fine-meshed gauze 13 facing the lower surface of the upper frame half 11(see FIG. 4A).

Second, the upper and lower frame halves 11 and 12 are nested with the Lower surface of the upper frame half 11 abutted against the outside flat edge 12A of the lower frame half 12, and when these frame halves 11 and 12 are fixed together by pushing the spring clips 41 in the recesses 11*c* and 12*c* of the frame halves 11 and 12. Then, the screen 7 is pulled outward in all directions so that the screen 7 may be stretched evenly over the frame (see FIG. 4B).

No extra device is required for stretching the screen 7 over the frame, and therefore, this fixing manner is economically advantageous.

Next, a platen 9 is put on the flat top 2, and the frame 8 having the screen 7 attached thereto is put on the flat top 2, overlying the platen 9. Then, the frame 8 is registered to the reference means in the form of 90 -degree angle lines 10 or ridges. The fine-meshed gauze side of the screen 7 is closely laid on the platen 9 (see FIG. 4*c*).

In this condition the X-axis drive motor 23 is made to start, thus putting the endless belts 17 and 20 in running condition to move the X-axis movable body 27 in the X-axis direction until it stops at a predetermined position. Next, the Y-axis drive motor 31 is made to start, and the threaded rod 28 is rotated in one or the other direction to drive the nut 29 along the threaded rod 28, and hence the Y-axis movable body 30 along the guide rail 32 in the Y-axis direction until it stops at a predetermined position.

Subsequently the solenoid 36 is energized to lower the rising-and-descending rods 34 along the opposite slotted guide poles 35, 35, and accordingly the heating head 3 is lowered until it has been put in contact with the underlying screen 7. Then, selected heating elements are supplied with electricity to make pores in the heat-sensitive film 14 according to data stored in the memory.

Such process is repeated to produce dotted patterns in the heat-sensitive film according to data representing image or letter patterns to be formed. Thus, the framed stencil results for use in silk-screen printing.

Figure 6:
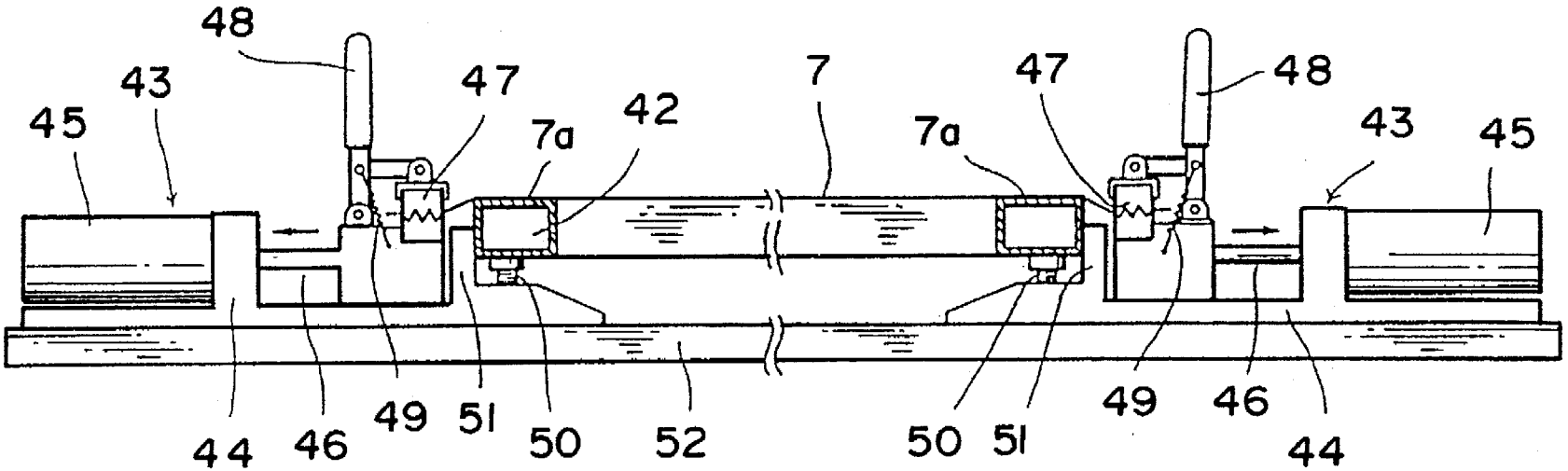
FIG. 6 shows, partly in section, another manner in which the screen is fixed to the frame.

FIG. 6 shows another example of stretching a screen over a frame and fixing it to the frame.

A screen 7 is laid on a rectangular screen frame 42 with the fine-meshed gauze side 13 down, and stretchers 43 are put symmetrically around the frame 42. The stretcher 43 comprises, on its base plate 44, a pneumatic cylinder 45 and an associated plunger 46, which has a pinch press 47 fixed to its end. The pinch press 47 is made to open by lowering its grip 48. The screen edge can be caught by the pinch press 47 by raising its grip 48 under the influence of spring 49.

All pinch presses 47 are pulled outward in the direction indicated by arrows by driving the associated pneumatic cylinders 45 so that the screen 7 is stretched evenly over the frame 42. The level at which the frame 42 is laid can be adjusted by adjusting screws 50 so that the stretched screen 7 is laid closely on the upper surface of the frame 42. The base plate 44 has stops 51, and the stretchers 43 are arranged around the frame 42 with the stops 51 abutting against the four sides of the frame 42. When driving the pneumatic cylinders 45, the base plates 44 of the stretchers 43 slide on the working table 52 by the counter action of the stretching of the screen 7 until the stops 51 have come to contact the frame 42, thus stopping the base plates 44 of the stretchers 43. After stretching the screen 7 over the frame 42, the heat-sensitive film 14 is peeled off from the margin 7*a* of the fine-meshed gauze, and an adhesive agent is applied to the exposed margin. After the adhesive agent thus applied has been dried and hardened, the pinch presses 47 are opened to release the screen 7, and then the framed screen is removed.

When peeling off the heat-sensitive film 14 from the fine-meshed gauze of the screen 7 an adhesive tape is applied to the heat-sensitive film 14 to peel it off from the margin 7*a* of the fine-meshed gauze of the screen 7 by pulling the adhesive tape. The adhesive agent can be evenly applied to the exposed margin of the fine-meshed gauze 13 of the screen 7 to fill the fine meshes of the margin 7*a*, thus sticking the screen 7 on the frame 42 firmly.

This stretching-and-fixing manner is advantageous to the sticking of a relatively large screen 7 to the frame; such a large screen can be stretched over the frame by increasing the pulling force of the pneumatic cylinders 45.

As described earlier, in gluing the fine-meshed gauze 13 and the heat-sensitive film 14 an oil adhesive agent must be used if an aqueous ink is used in printing, and an aqueous agent must be used if an oil ink is used in printing; use of the wrong adhesive agent will cause the peeling of the heat-sensitive film around pore patterns, thus deteriorating the quality of the stencil. Such undesired peeling-off can be prevented by forming a protection coating on the fine-meshed gauze side 13 of the screen.

To form such a protection coating on the fine-meshed gauze side 13 of the screen a photo-sensitive emulsion is evenly applied to the rear side of the screen, and then extra emulsion is removed by wiping the front side of the screen with a wet piece of cloth. The screen thus coated with the photo-sensitive emulsion is exposed to light to be hardened by the action of light. The so formed coating has the effect of protecting the heat-sensitive film from peeling off around pore patterns no matter what kind of printing ink may be used, thus keeping the stencil in good condition.

Solvent-resistant, photo-sensitive emulsions (commercially available from K.K. Mino Group under the trade name of "M coat D") or water-resistant, photo-sensitive emulsions (commercially available from Kurita Kagaku Kenkyusho under the trade name of "SD-40") are appropriate for use in forming protection coatings.

Thick protection coating have the effect of increasing the thickness of ink printing, thereby providing rising appearance of images or letters.

In the embodiments described above the frame 8 is fixed to the flat top 2 while moving the heating head 3. As a matter of course a stationary heating head 3 may be used, and then a framed stencil is moved.

As may be understood from the above, a screen having a heat-sensitive film attached thereto is stretched over and fixed to a frame; and pores are made in the heat-sensitive film by a heating head while keeping the screen stretched and fixed to the frame so that the pores thus made may be placed in correct positions relative to the frame, thus eliminating the necessity of taking the trouble of putting the stencil in exact position and fixing it to the frame.

Advantageously framed stencils which are produced according to the present invention are guaranteed to be free of causing any drifts in printing. In case of multi-color printing two or more stencils are necessitated. Framed stencils produced according to the present invention cause no color drifts because exact registrations can be assured in printing. All kinds of stencils for use in silk-screen printing can be produced according to the present invention.

What is claimed:

1. Method of producing stencils for use in silk-screen printing, using a frame, a flat table, a platen, a heating head and silk, comprising the steps of:

stretching the silk over the frame;

providing a heat sensitive film attached to the silk, fixing the silk and heat sensitive film stretched over the frame, the fixed silk and heat sensitive film as well as the frame forming a silk-screen;

putting the frame on the flat table at a predetermined position, allowing the silk to contact the platen; mounting the heating head for movement, and sweeping the silk-screen with the moveable heating head to make pores in the heat-sensitive film of the silk-screen, thereby producing a framed stencil.

2. The method as defined in claim 1, wherein the frame comprises two pieces, and wherein the silk is stretched over the frame by the movement of one piece of said frame relative to the other piece of said frame.

3. The method as defined in claim 1, wherein the whole area of the platen is covered by the silk.

* * * * *